US008875889B2

(12) United States Patent
Smith

(10) Patent No.: US 8,875,889 B2
(45) Date of Patent: Nov. 4, 2014

(54) PACKAGING CUSHION STRUCTURE MADE FROM STIFF PAPER-BOARD SHEETS

(75) Inventor: Forrest Smith, Santa Ana, CA (US)

(73) Assignee: Reflex Packaging, Inc., Santa Ana, CA (US)

( * ) Notice: Subject to any disclaimer, the term of this patent is extended or adjusted under 35 U.S.C. 154(b) by 762 days.

(21) Appl. No.: 12/709,994

(22) Filed: Feb. 22, 2010

(65) Prior Publication Data

US 2011/0203962 A1 Aug. 25, 2011

(51) Int. Cl.
*B65D 81/02* (2006.01)

(52) U.S. Cl.
USPC ..... 206/521; 206/586

(58) Field of Classification Search
USPC ..... 206/591–594, 521, 586, 453
See application file for complete search history.

(56) References Cited

U.S. PATENT DOCUMENTS

| | | | | |
|---|---|---|---|---|
| 3,231,454 | A | 1/1966 | Williams | |
| 4,874,095 | A * | 10/1989 | Warych | 206/586 |
| 4,953,705 | A | 9/1990 | Evamy | |
| 5,131,543 | A | 7/1992 | Stephens | |
| 5,175,041 | A * | 12/1992 | Webb et al. | 206/586 |
| 5,184,727 | A | 2/1993 | Dickie | |
| 5,529,187 | A | 6/1996 | DeNola | |
| 5,532,044 | A | 7/1996 | Jen | |
| 5,626,229 | A | 5/1997 | Dickie et al. | |
| 5,806,683 | A | 9/1998 | Gale | |
| 5,915,556 | A | 6/1999 | Simpson | |
| 6,199,700 | B1 * | 3/2001 | Yamamoto et al. | 206/586 |
| 7,097,043 | B2 | 8/2006 | Hsu | |

FOREIGN PATENT DOCUMENTS

| | | |
|---|---|---|
| EP | 0798111 A1 | 12/1996 |

* cited by examiner

*Primary Examiner* — Andrew Perreault
(74) *Attorney, Agent, or Firm* — Laubscher & Laubscher, P.C.

(57) ABSTRACT

A product cushioning structure for supporting a shock sensitive product in an outer packaging container having a plurality of container walls has at least two interconnected outer container-contacting panels for supporting and stabilizing the cushioning structure within the outer packaging container in at least two mutually perpendicular directions. At least two inner product-supporting panels support the shock sensitive product within the cushioning structure. Intermediate wall sections extend between the outer container-contacting panels and the inner product-supporting panels. The intermediate wall sections, outer container-contacting panels and inner product-supporting panels are made of a stiff paper-board material and are joined together to form box-like cells between the respective inner product-supporting panels and outer container-contacting panels. The cells are crushable to provide shock absorption support to the product during shock loading conditions. They are arranged in or foldable into a mutually angled configuration so that the cushioning structure provides shock absorption support to the product during shock loading conditions in at least two mutually perpendicular directions. The box-like cells may comprise an open box-like component formed by the intermediate wall sections and the inner product-supporting panels, and a unitary planar component formed by the outer container-contacting panels. The unitary planar component is bonded to the open box-like component at the periphery thereof to inhibit splaying of the intermediate wall sections in the presence of a shock loading in a direction normal to the inner product-supporting panels.

35 Claims, 13 Drawing Sheets

PACKAGING CUSHION STRUCTURE MADE FROM STIFF PAPER-BOARD SHEETS

FIELD OF THE INVENTION

This invention relates to the field of product packaging, and more particularly to a product cushioning structure suitable for packaging products such as sensitive electronic equipment.

BACKGROUND OF THE INVENTION

Many products, and in particular electronic products, that are transported today require protection from shock. Conventional structures used in protective packaging are made of expanded polyurethane, polystyrene, polyethylene and polypropylene foams and other molded resin materials. Such foams and resin materials are widely used in industry because of their economical advantage but they are not recyclable or biodegradable. Unfortunately, these materials are commonly used one time and then discarded to end up as permanent matter in landfills.

Materials including paperboard, poly-coated paper or plastic film are economically efficient and proven to be eco-friendly such that they can be easily included within present recycling systems. Generally, paperboard and many other sheet form materials can be manufactured efficiently and in high volume, thus driving their relative price down.

Many sheet materials exhibit very high compressive and tensile strength sufficient to support the weight of packaged products when combined properly. However, existing paperboard or flat stock based packaging products do not sufficiently take advantage of the properties of the materials they are made of and do not effectively protect the products they contain. As a result, either more packaging material or greater box volume is required in order to to adequately protect a given component from shock, making such products economically and environmentally unsuitable.

There is a significant need for protective packaging that is economically competitive and easily recyclable.

SUMMARY OF THE INVENTION

According to one aspect of the present invention there is provided a product cushioning structure for supporting a shock sensitive product in an outer packaging container having a plurality of container walls, said cushioning structure comprising: at least two interconnected outer container-contacting panels for supporting and stabilizing the cushioning structure within the outer packaging container in at least two mutually perpendicular directions; at least two inner product-supporting panels for supporting the shock sensitive product within the cushioning structure; and intermediate wall sections between said outer container-contacting panels and said inner product-supporting panels; and wherein said intermediate wall sections, said outer container-contacting panels and said inner product-supporting panels are made of a stiff paper-board material; wherein said intermediate wall sections, said outer container-contacting panels and said inner product-supporting panels are joined together to form box-like cells between said respective inner product-supporting panels and said outer container-contacting panels, said cells being crushable to provide shock absorption support to said product during shock loading conditions; and wherein said panels are arranged in or foldable into a mutually angled configuration so that said cushioning structure provides shock absorption support to said product during shock loading conditions in at least two mutually perpendicular directions.

In this specification the term box or box-like is used to describe the fact that the cells generally have the shape of a box structure with well defined edges. The box structure may be square or rectangular, but it does not have to be, and preferably it has inclined intermediate wall sections so that it is trapezoidal in cross section. These inclined wall sections should preferably be inclined at an angle of at least 70 degrees. This latter configuration has the advantage that it inhibits the tendency of the box-like cells to skew sideways under shock loading conditions rather than collapse in the direction normal to the panels, which are typically parallel to each other. Using flat panels allows them to mate snugly with the container and product, although they could be formed in such as way as to include other shapes on their surface, such as dimples and pyramids.

The present invention thus provides a novel product cushioning structure in the form of protective packaging insert made of materials, each preferably of uniform thickness, that are preferably folded and bonded together to form a closed structure which is sufficiently rigid for cushioning a shock sensitive component such as an electronic device. The closed structure of the material is rigid and is designed to yield under load. The folds and bonds work together to form a system that efficiently controls the yield points thus controlling the rate of deceleration of the product being packaged. The packaging materials may be made of paperboard, poly-coated paper, plastic film or a combination thereof. All the bonding surfaces are preferably located along a common plane.

The paper-board material is preferably recycled or recyclable materials that are of uniform thickness, foldable and bondable to one another to form a damping cushion. The paper-board must be sufficiently stiff to provide integrity to the cells yet collapse under shock loading conditions. Typically, the thickness of the paper-board material lies in the range 14-30 thousands of an inch, but the nature and thickness of the material can be selected in accordance with the particular application in hand.

In one embodiment, a paper-board material comprising a 15% by weight blend of polyethylene is employed, a suitable range lying between 10 and 25% by weight. The paperboard may also be plastic coated. In either case, the presence of the plastic allows the material to be joined by heat sealing or welding using the plastic as the bonding agent. This is a particularly economical and effective way of making the structure.

In one embodiment, lines of weakening, such as crease or score lines, are formed in the intermediate wall sections to facilitate collapse in the desired direction.

In another aspect the invention provides a product cushioning structure for supporting a shock sensitive product in an outer packaging container having a plurality of container walls, said cushioning structure comprising: at least two interconnected outer container-contacting panels for supporting and stabilizing the cushioning structure within the outer packaging container in at least two mutually perpendicular directions; at least two inner product-supporting panels for supporting the shock sensitive product within the cushioning structure; and intermediate wall sections between said outer container-contacting panels and said inner product-supporting panels; and wherein said intermediate wall sections, said outer container-contacting panels and said inner product-supporting panels are made of a stiff paper-board material; wherein said intermediate wall sections, said outer container-contacting panels and said inner product-supporting panels are joined together to form box-like cells between said respective inner product-supporting panels and said outer container-contacting panels, said cells being crushable to provide shock absorption support to said product during shock loading conditions; and wherein said box-like cells comprise an open box-like component formed by said intermediate wall sections and said inner product-supporting panels, and a unitary planar component formed by said outer container-contacting panels, wherein said unitary planar component is bonded to said open box-like component at the periphery thereof to inhibit splaying of said intermediate wall sections in the presence of a shock loading in a direction normal to said inner product-supporting panels.

BRIEF DESCRIPTION OF THE DRAWINGS

The invention will now be described in more detail, by way of example only, with reference to the accompanying drawings, in which.

DETAILED DESCRIPTION OF EMBODIMENTS OF THE INVENTION

Figure 1:
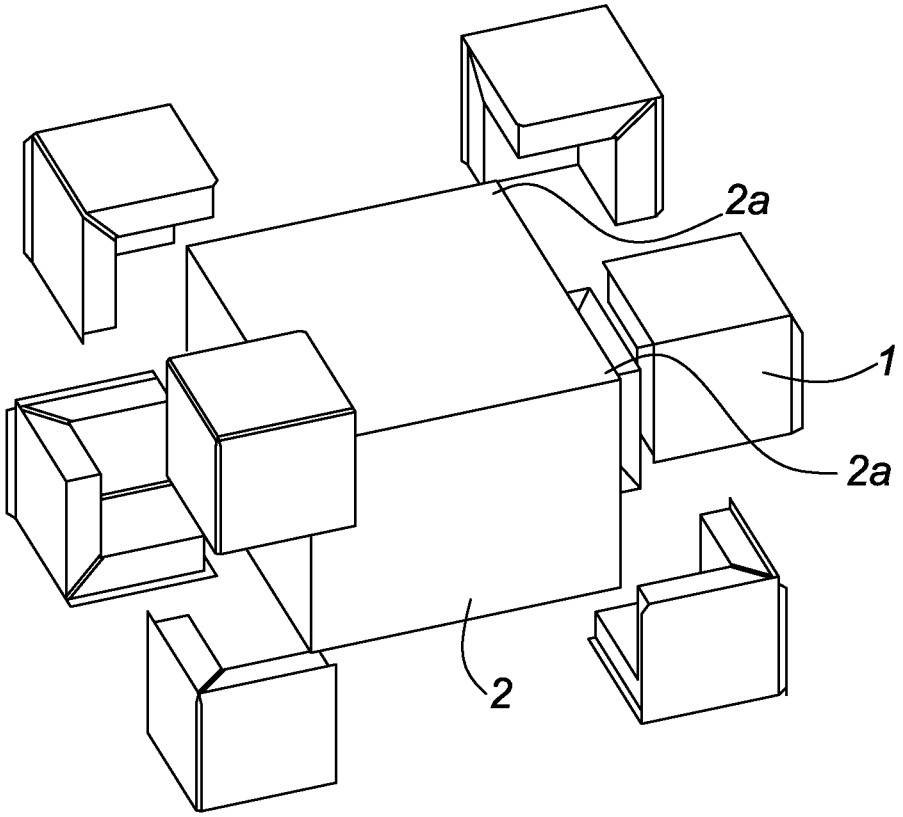
FIG. 1 shows a product cushioning structures with a corner configuration arranged around a product.

FIG. 1 shows a plurality of corner shaped packaging inserts 1, each of which forms a product cushioning structure, snugly fitted against the outer corners 2*a* of a box-like product 2 that it is designed to protect against shock. The product 2 can be any kind of product that needs shock protection, for example, a computer component, such as a hard drive.

Figure 2:
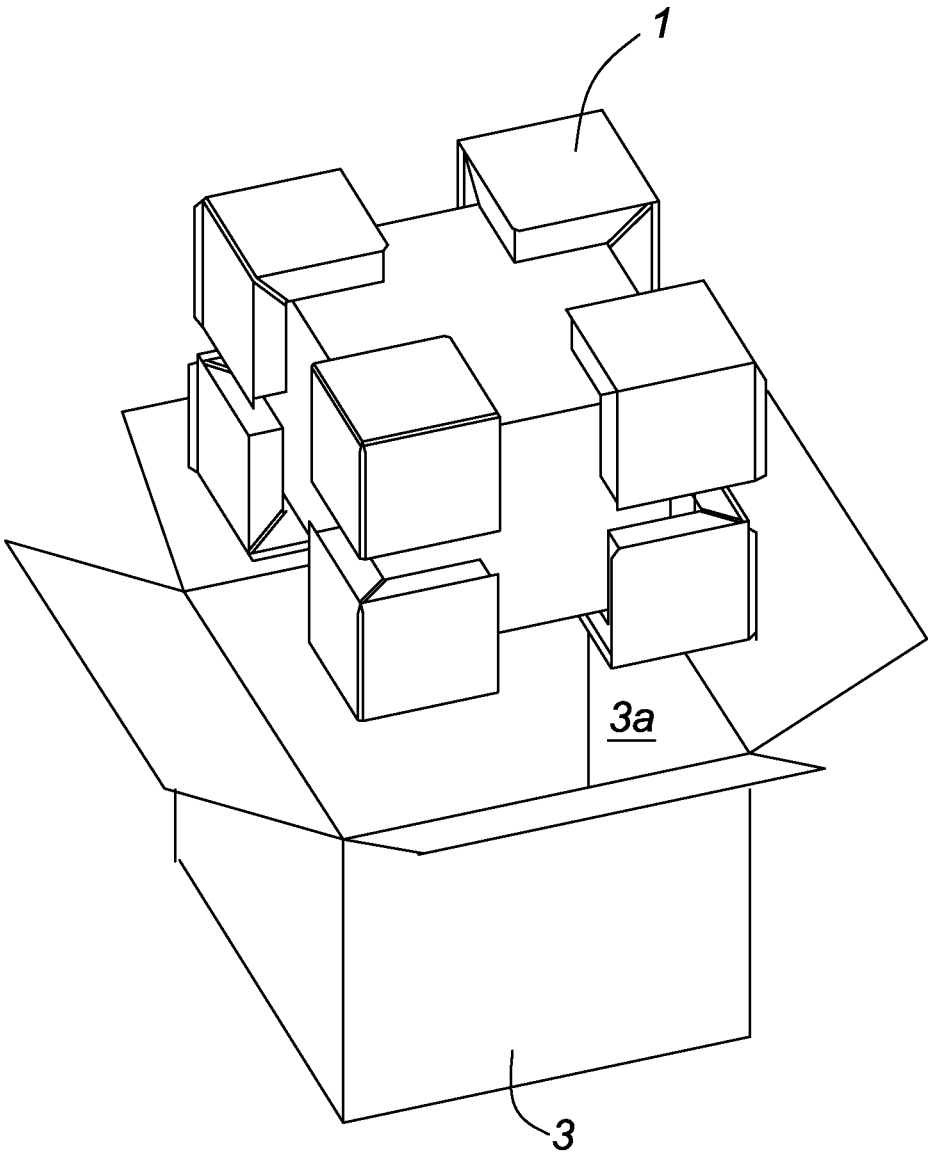
FIG. 2 shows the product being inserted into a container.

The entire assembly consisting of the product 2 and inserts I is friction fitted into the interior 3*a* of container 3, as shown in FIG. 2. The container 3 and inserts 1 are sized such that the assembly fits snugly within the container, with the inserts 1 providing cushioning support between the container walls and the product 2 during shock loading conditions.

Figure 3:
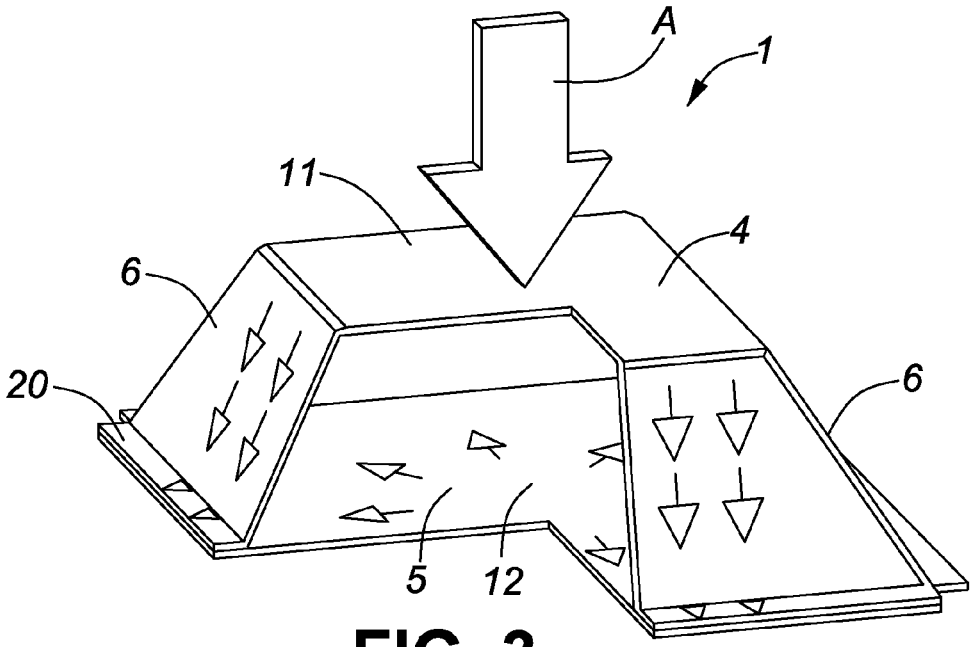
FIG. 3 illustrates a box-like cell.

The insert 1 comprises a group of box-like cells, one of which is shown in FIG. 3. Each cell is made of two separate sheets of stiff paper board that form a unitary structural load bearing component 4 and a flat stabilizing component 5. The box-like cells preferably have inclined nearly vertical sidewalls 6 and are generally trapezoidal in cross section with the walls inclined at about 70 degrees to the flat stabilizing component 5.

In the presence of vertical shock loading in the direction of the arrow A, the box-like cells collapse in the vertical direction with the sidewalls 6 having a tendency to splay apart. This tendency is resisted by the flat stabilizing component 5, which is in the form of container-contacting panel 12 bonded to the structural load-bearing component 4. The structure works better when the box-like cell has inclined walls as shown in FIG. 3 because otherwise there is a tendency for the whole structure to skew sideways rather than collapse vertically.

The paper-board material is preferably coated or blended with plastic. A suitable material, sold by Cellmark AB of Gothenburg Sweden, has a thickness of 14 to 30 thousands of an inch, and comprises a blend of paper-board and 15% polyethylene. A range of 10 to 25% is suitable.

Figure 4:
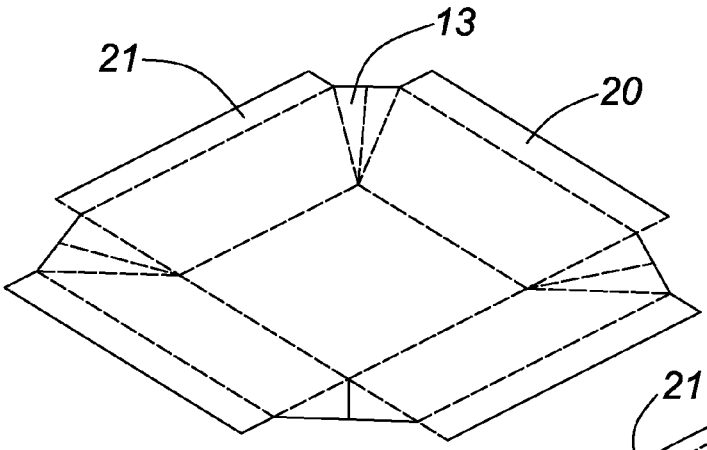
FIG. 4 shows a precursor open box-like cell in the partially folded position.

To make a box-like cell, the flat sheet that forms the structural component 4 is folded into a box shape as shown in FIG. 4 so that a section through the structure forms a trapezoid.

Figure 6A:
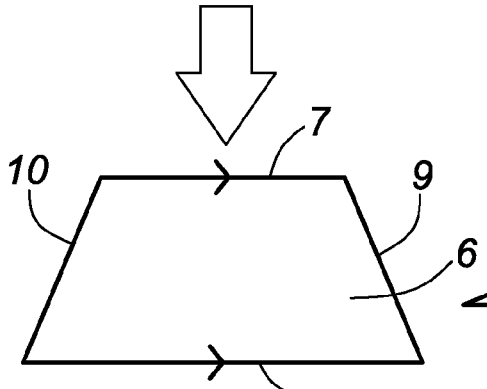
FIGS. 6*a* to 6*c* show cross sections through the box-like structure in different stages of collapse.
Figure 6B:
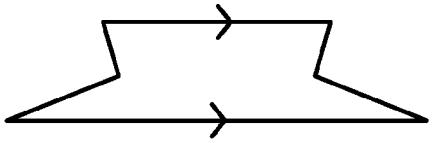
Figure 6C:
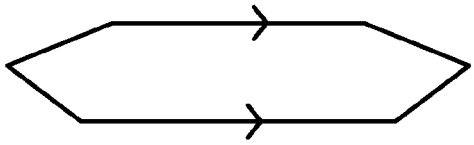

As shown in FIGS. 6*a* to 6*c*, the base members 7 and 8 of any trapezoid are parallel to one another and the vertical sections or legs 9 and 10 may be approximately perpendicular or at an angle to the base members. In this case, the base members comprise the face 11, or inner product supporting panel, that makes contact with the object being protected and the opposite face, or outer container-contacting panel 12, which makes contact with the interior of the box-like cell containing the packaged assembly. These two faces are generally parallel to one another, although strict parallelism is not essential.

Figure 5:
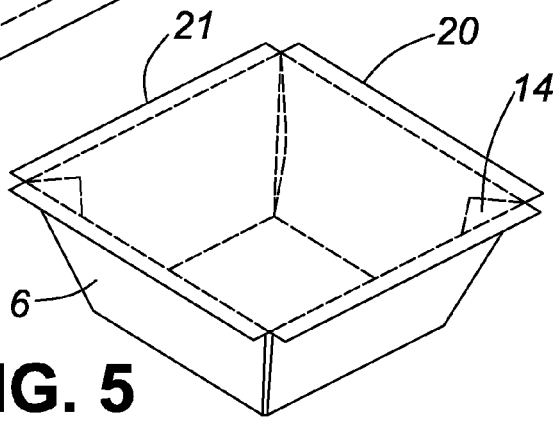
FIG. 5 shows the open box-like cell in the fully formed position.

The top panel 11, which contacts the component, and the two legs 9 and 10 forming intermediate wall sections 6 of the trapezoid are formed from the same single sheet which is die-cut and folded to form the desired shape. FIG. 4 shows the partially folded die-cut blank with pleated corners 13 and tabs 20 and 21. The fully folded component is shown in FIG. 5 with pleat folds 14 extending into the interior of the box-like cell.

Unlike regular paperboard box designs, the folded shape of the structural component is not cut in the corners 13 to provide fold reliefs. While regular folding objects provide such relief cuts to facilitate folding into 3-dimensional shapes, this otherwise excess material in the corners 13, creates additional pleat folds 14 along the vertical corners to facilitate the shape of the cushion and thus create added rigidity in the vertical axis.

Figure 7A:
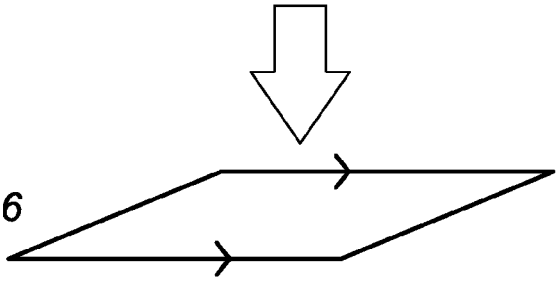
FIGS. 7*a* and 7*b* illustrate a parallelogram collapse.
Figure 7B:
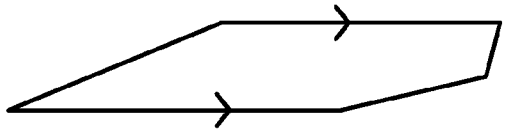

The structure from these resultant corners is used as an integral part of the cushioning, which significantly contributes resistance to the load applied by the packaged component. Another important function of the folded corner 13 is that it maintains the stability of the structural shape by providing unbroken connection with adjacent facets keeping the trapezoid rigid along its sectional area. Without this connection, the trapezoidal section may be vulnerable to a parallelogram collapse as shown in FIGS. 7*a* and 7*b*. A parallelogram might easily collapse and cancel out any structural advantage of the system.

In addition to forming the top base member 7 and the two legs 9 and 10, the main sheet also is folded to provide tabs 20, 21, which connect the top sheet to the bottom flat panel 12.

This arrangement of base members of the trapezoid may be reversed such that the folded sheet is in contact with the outer box.

Shock on a packaged product occurs most commonly parallel to the vertical direction and is caused by gravity as when a box is accidentally dropped from a given height. All protective packaging cushions seek to extend the duration of deceleration and/or dissipate energy away from the direction of impact.

Under static conditions, the force of gravity exerted on the component being packaged is supported by the compressive strength of the vertical walls 6 of the folded structure, which transfer the load down towards the tabs 20, 21, which are bonded to the stabilizing panel 12. Because they are bonded at the base, the legs 9 and 10, forming the walls 6, do not spread open under this load but instead transfer the load to the vertically and exert a horizontal tensile force along the plane of the bottom stabilizing panel 12 as shown in FIG. 3.

Figure 8A:
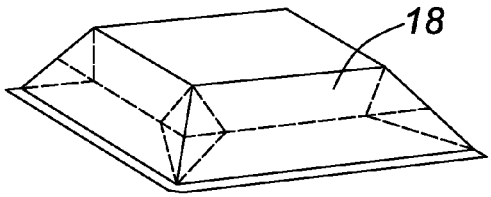
FIGS. 8*a* to 8*d* are more detailed views of the product cushioning structure.
Figure 8B:
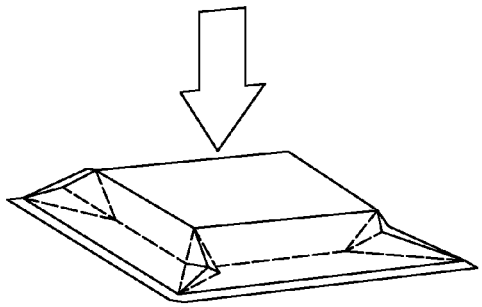
Figure 8C:
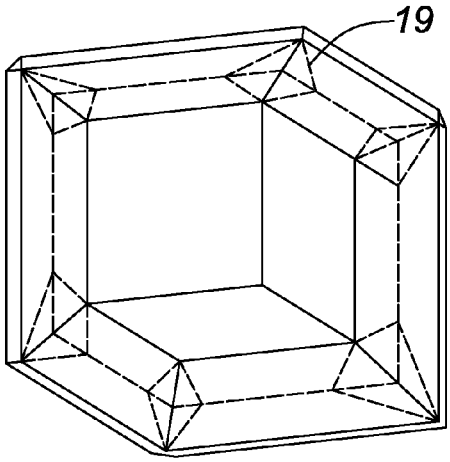
Figure 8D:
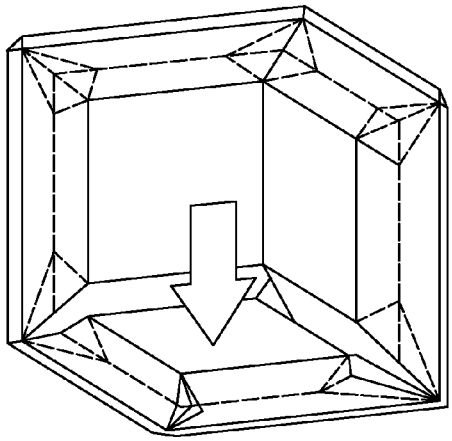

During freefall, the packaged product is accelerated by gravity towards the ground and reaches its maximum velocity upon impact. At this point, the force from the product is transmitted downward through the nearly vertical walls 6 into the ground and through the bottom stabilizing panel 5 that it is bonded to it. A pulling force is applied along the bottom sheet but its tensile strength is sufficient to overcome such force and so maintains its dimension. Therefore the load is concentrated back to the nearly vertical walls 6 of the trapezoid. These walls are designed to deflect and then collapse at predetermined yield points by way of deliberately pre-creased lines 18 and 19 which are built into the legs or intermediate wall sections of the trapezoid. This deflection distributes the force of impact horizontally towards the interior of the box, into the wall of the outer box, towards the interior of the cushion and into adjacent cushions thereby distributing the force of the shock over multiple directions, as shown in FIGS. 8*b* and 8*d*. This extends the time of the deceleration and achieves much improved damping.

Figure 9B:
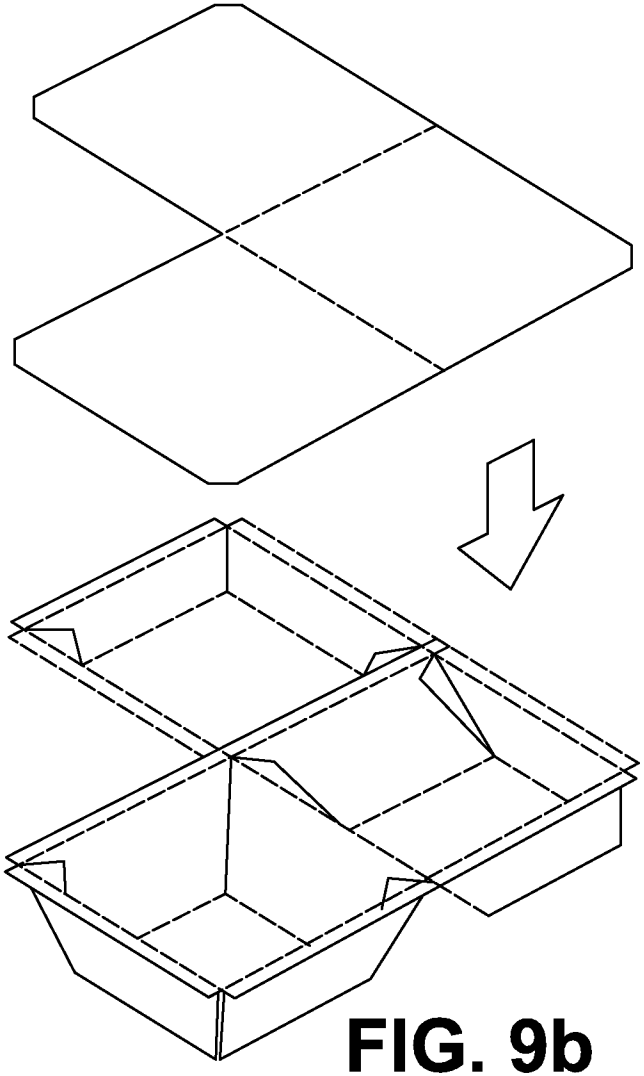
FIGS. 9*a* to 9*c* illustrate the manufacture of a product cushioning structure with a corner configuration.
Figure 9A:
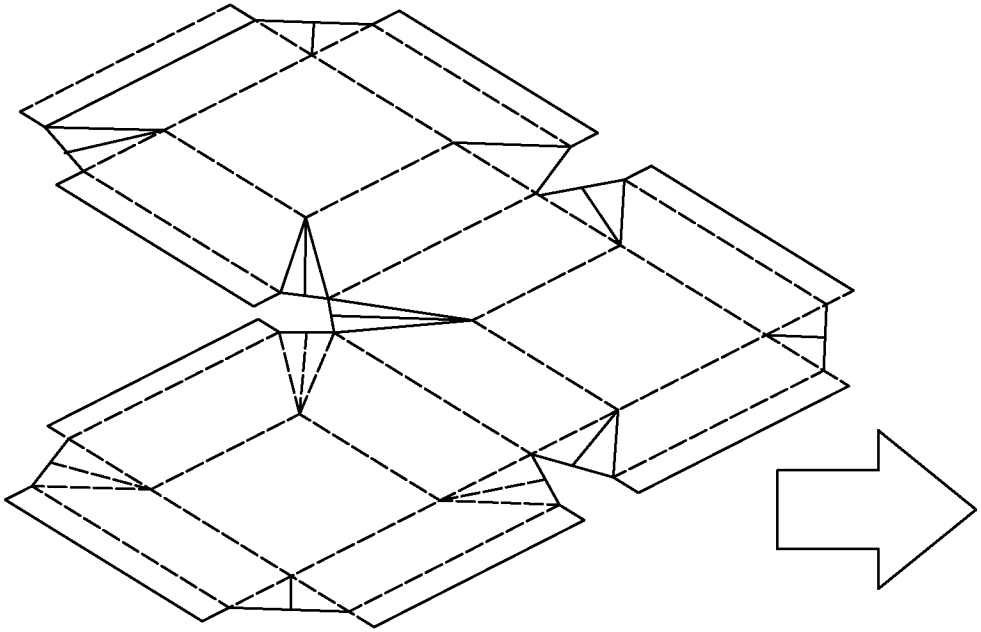
Figure 9C:
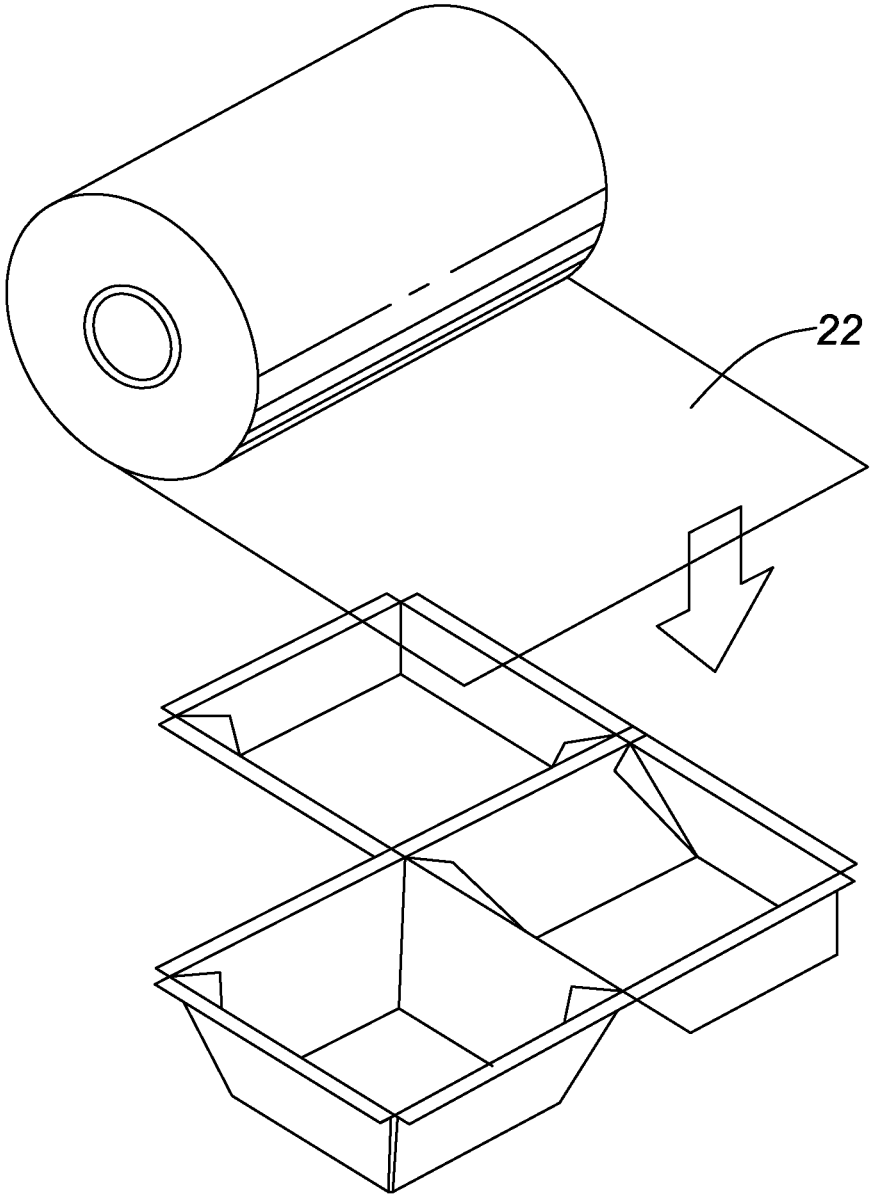

The flat structural sheet from which the box-lie cells are made ma be pre-creased so that it easily folds to form a cushion cell or a series of joined cells whose cross section forms an open box or boxes and is placed in a holding jig to retain its overall shape. At the top edges of each cell are tabs 20, 21, which are meant for bonding. Another flat sheet 22 (FIG. 9*c*), which is the stabilizing sheet, is placed over the jig containing the folded first sheet and the two sheets are bonded together at the tabs by direct heat welding, RF welding, ultrasonic welding or by use of an adhesive agent. Welding is facilitated by the fact that the paper-board is plastic coated, or contains plastic.

The rate of damping required for a given object is dependent upon its fragility with consideration to the conditions of the environment it will be transported in including methods of transport, storage and handling. The individual cells of the cushioning insert may be designed to produce specific damping results by varying the total cushion distance, by selecting the most appropriate materials and by specifying the proper caliper thicknesses of both the structural sheet and the stabilizing sheet. Damping is also controlled by varying the geometry and number of corner folds 13 and varying the locations of yield point patterns 24 and 25 on the nearly vertical faces of the structural sheet. The deliberate placement of these elements will determine the resistance, yield characteristics, energy distribution and sequence of collapse of the structure such that an event of impact can be carefully controlled.

Figure 10A:
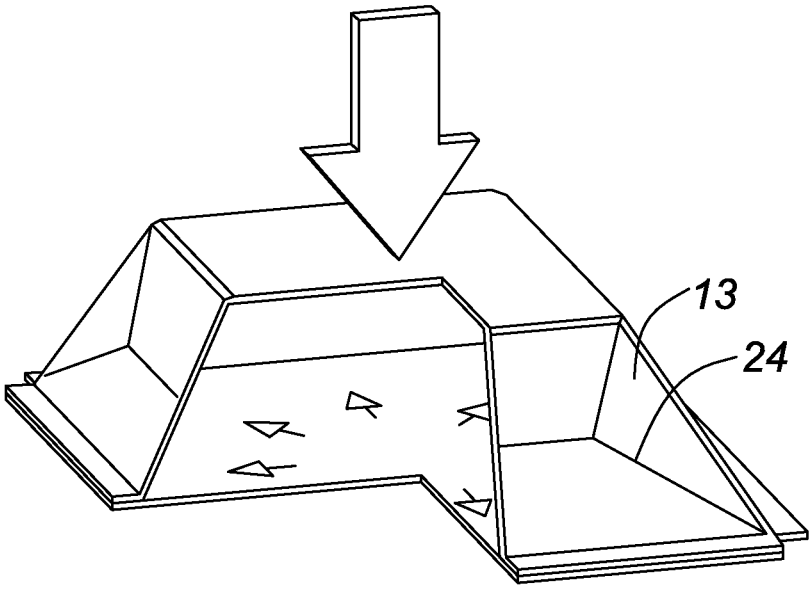
FIGS. 10*a* and 10*b* illustrate the forces acting on a box-like cell of trapezoidal configuration.
Figure 10B:
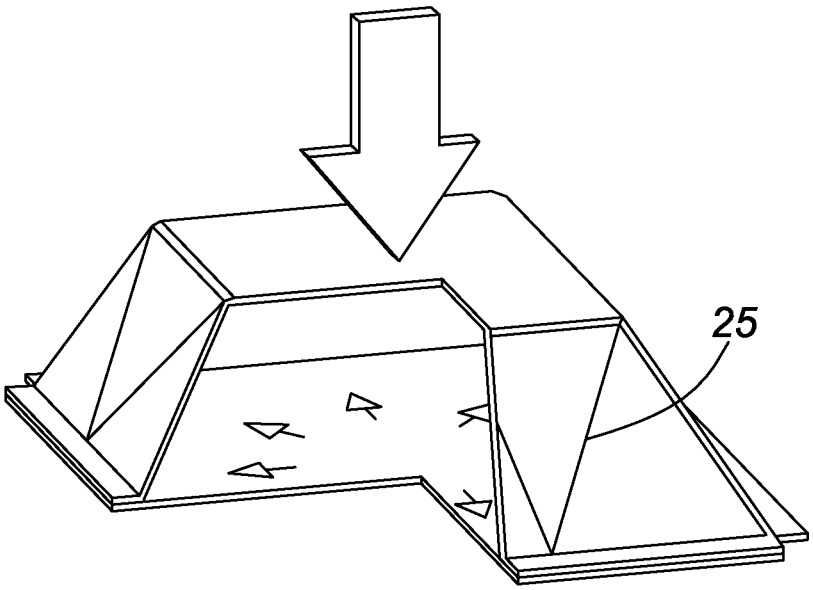
Figure 11A:
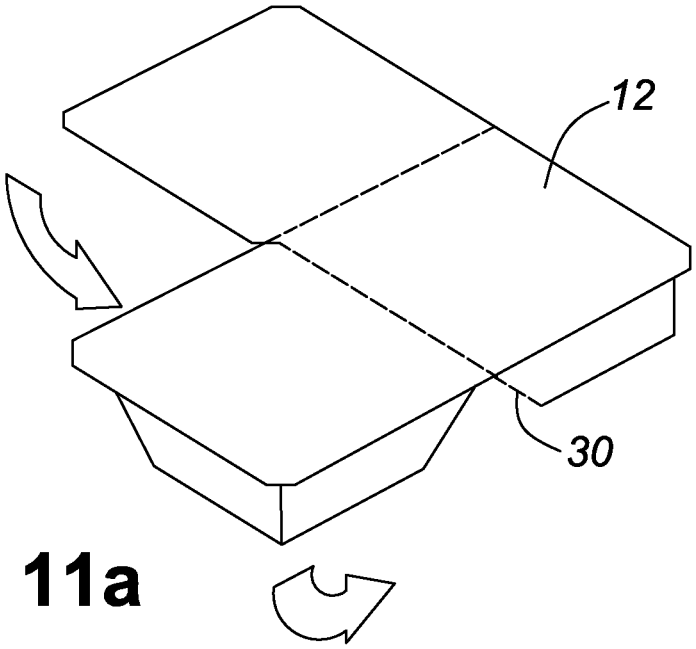
FIGS. 11*a* and 11*b* are views of the corner configuration from the outer side.

A cushioning cell may function on its own (FIGS. 10*a*, 10*b*) or may be bonded to a common sheet (FIGS. 9*a* to 9*c*) with other cushioning cells to form a single array FIG. 11*a* of cushions. This sheet of cushions may be folded (FIG. 11*b*) such that different cells of the array are oriented to protect different faces of the object to be protected.

A stabilizing sheet may be made of materials that exhibit elastic properties or may be made to deform. This embodiment would further transfer and dissipate the energy of the impact.

The bases of the cushion structure may be made in any rectilinear shape and have three or more folded corners and three or more vertical faces.

The bonding line is planar which makes the manufacturing easily transferable to different types of existing machinery.

Figure 11B:
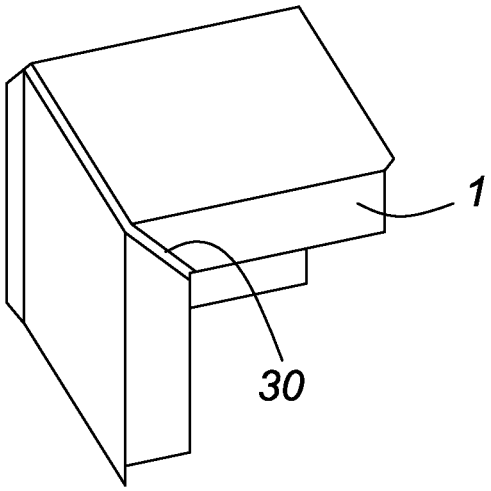

FIGS. 11*a* and 11*b* show foldable corner structures consisting of three cells 4 with mutually facing sidewalls 30 beveled at 45 degrees so that the structure shown in FIG. 11*a* can be folded into a corner configuration.

Figure 12A:
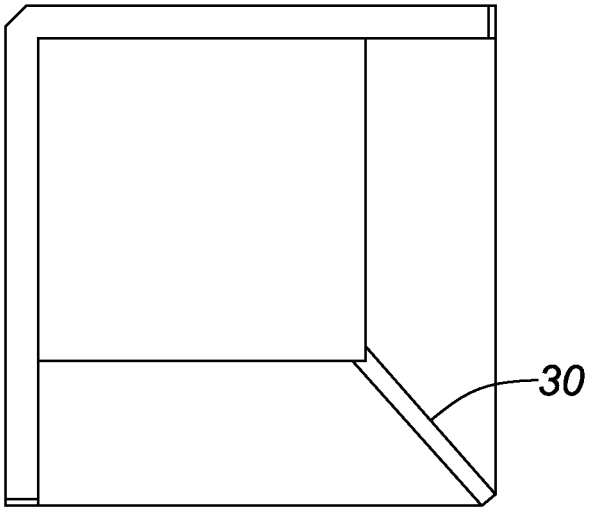
FIGS. 12*a* and 12*b* illustrate the forces acting on a corner structure during shock loading.
Figure 12B:
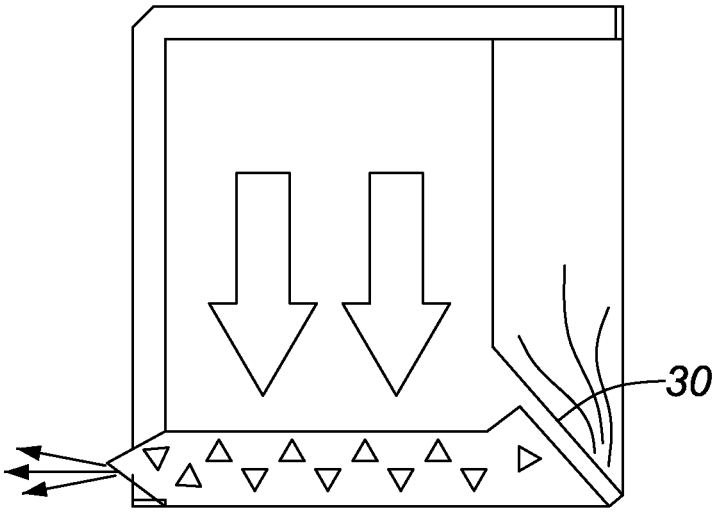

FIGS. 12*a* and 12*b* illustrate the response of a corner structure to shock loading conditions. As will be seen in FIG. 12*b*, the vertical shock is transferred into the horizontal direction and partly upwardly through the mutually contacting beveled edges 30.

Figure 13A:
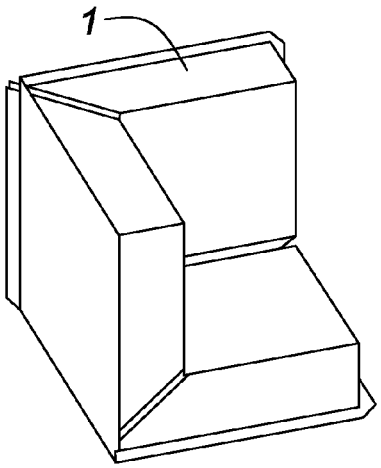
FIGS. 13*a* and 13*b* illustrate fixed cushioning structures.
Figure 13B:
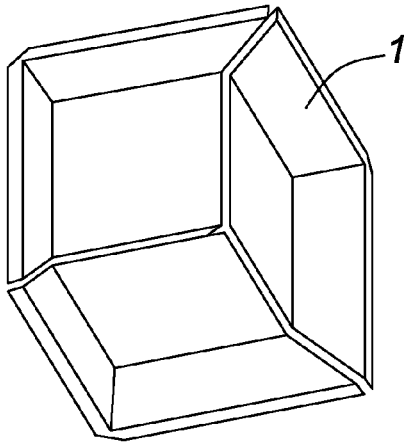

FIGS. 13*a* and 13*b* show fixed corner piece inserts 1. The inserts do not have to be foldable, and in the embodiment shown in FIGS. 13*a* and 13*b* are bonded together as fixed pieces.

Figure 14A:
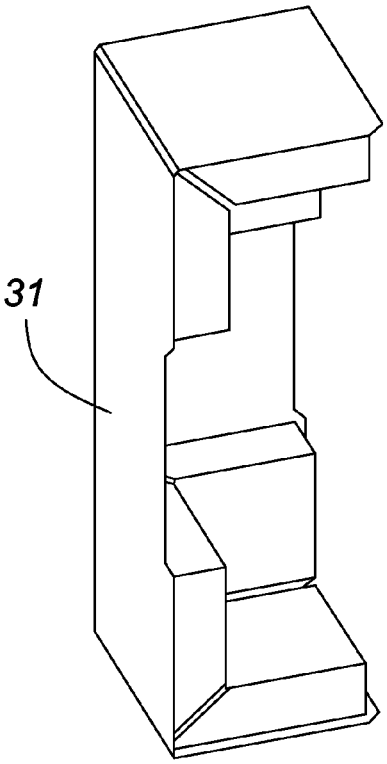
FIGS. 14*a* and 14*b* illustrate another type of fixed cushioning structure.
Figure 14B:
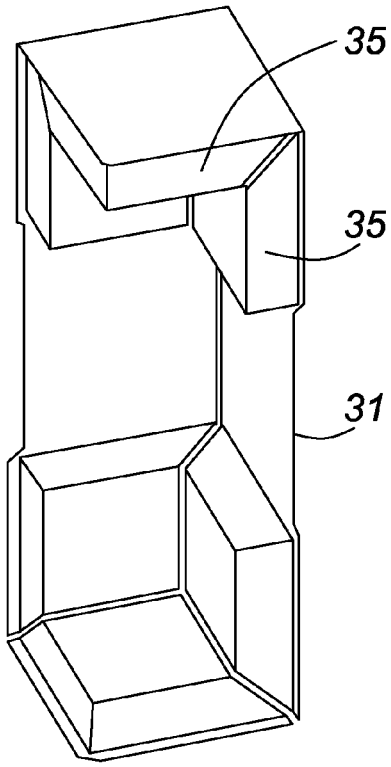

The embodiment shown in FIGS. 14*a* and 14*b* shows three box-like cells 35 located at opposite ends of a cut-away open rectangular casing 31. In this case, the entire assembly forms the cushioning structure and may be fitted onto the end of a rectangular product to be protected. The completed inserts as illustrated in FIG. 3 can be bonded to the casing 31, or alternatively the walls of the casing can provide the stabilizing panels directly. In the former embodiment it will be appreciated that the stabilizing panels will, in use, contact the inner wall of the container 3 indirectly through the walls of the end casing 31.

Figure 15A:
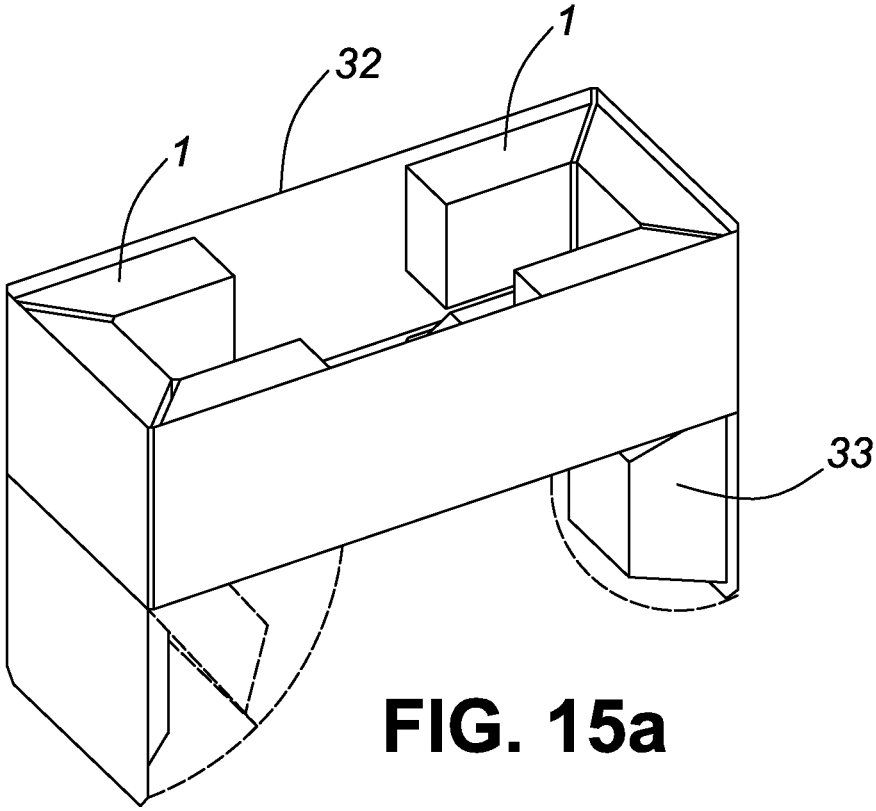
FIGS. 15*a* and 15*b* illustrate still further type of cushioning structure.
Figure 15B:
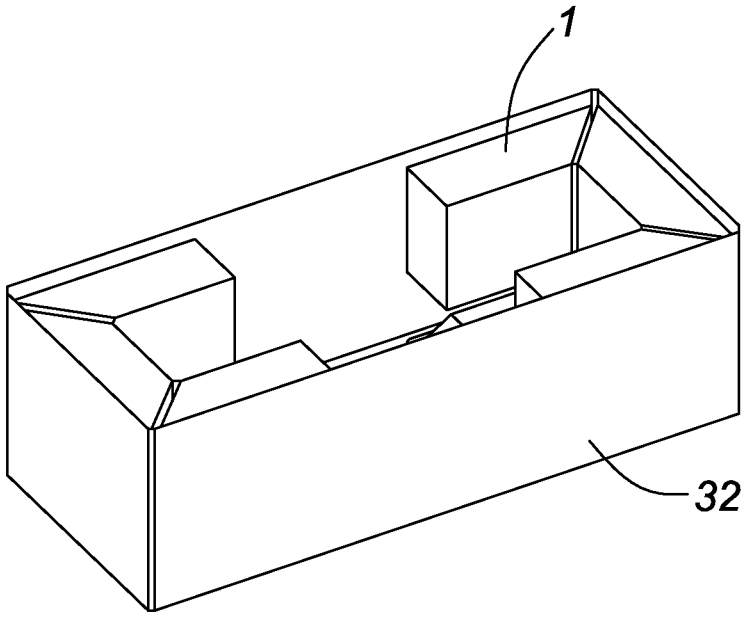
Figure 16A:
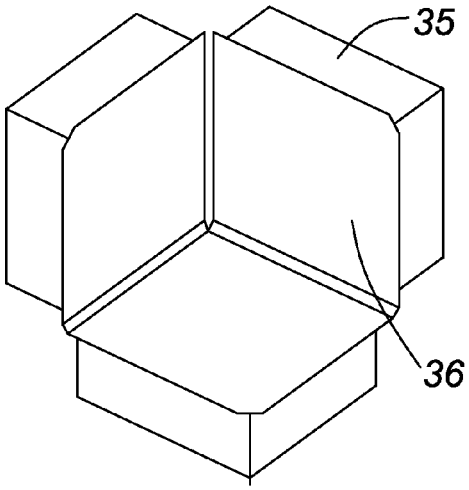
FIGS. 16*a* and 16*b* illustrate a cushioning structure with the box-like cells on the outside.
Figure 16B:
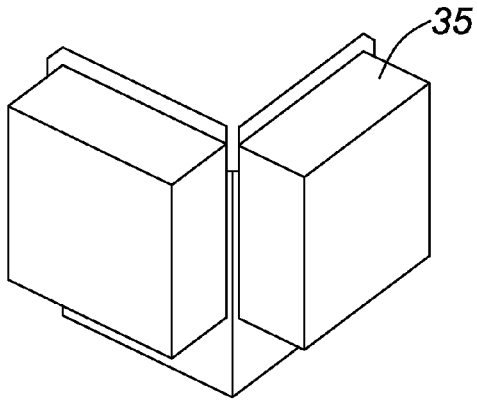
Figure 17A:
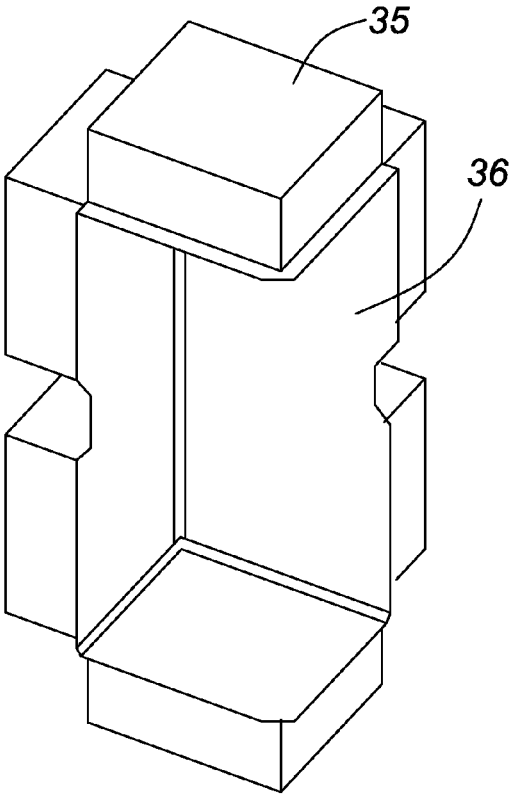
FIGS. 17*a* and 17*b* illustrate a more complex cushioning structure with the box-like cells on the outside.
Figure 17B:
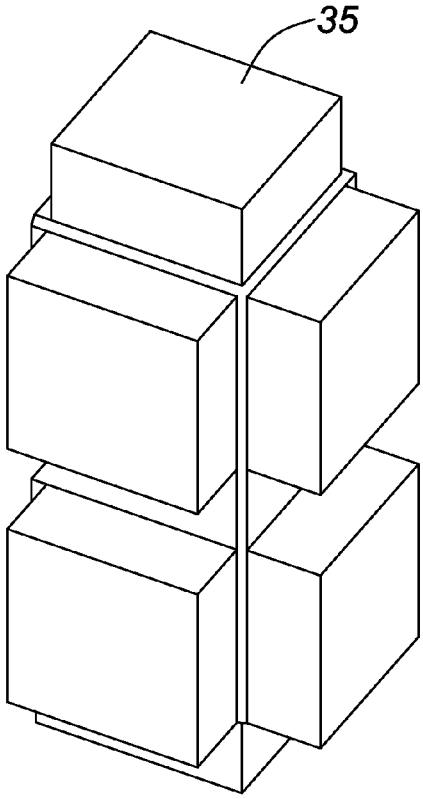

FIGS. 15*a* and 15*b* illustrate an end cap arrangement wherein a pair of inserts 1 are inserted into a casing 32 open at opposite sides. The lower flaps of the inserts 33 are foldable into the end casing 32 to allow the end casing 32 to be closed off after it has been fitted around the end of a product.

FIGS. 16*a*, 16*b* and 17*a*, 17*b* show alternative configurations wherein box-like cells 35 are mounted on the outside of the stabilizing panels 36. In this case, of course, while it is desirable for the cells to be slightly trapezoidal in shape, they do not need to be beveled at the edges.

The box-like cells may also provide additional cushioning by trapping air or other gas within them. When they are crushed, they may burst allowing restricted release of the air within them to contribute to the damping effect.

I claim:

1. A product cushioning structure for supporting a shock sensitive product in an outer packaging container having a plurality of container walls, said cushioning structure comprising:

at least two interconnected outer container-contacting panels for supporting and stabilizing the cushioning structure within the outer packaging container in at least two mutually perpendicular directions;

an inwardly facing hollow crushable box cell provided on each of said outer-container contacting panels to provide shock absorption support to said product during shock loading conditions, each said crushable box cell comprising:

an inner product-supporting panel for supporting the shock sensitive product within the cushioning structure, and intermediate wall panels extending between said inner product supporting panel and a unitary planar component formed by one of said outer container-contacting panels providing an outer wall of said crushable box cell, and wherein at least one opposing pair of said intermediate wall panels are inclined such that said crushable box cell has a trapezoidal shape in cross section;

wherein said unitary planar component is bonded to said open crushable box cell at the periphery thereof to inhibit splaying of said inclined intermediate wall panels in the presence of a shock loading in a direction normal to said inner product-supporting panels; and wherein said outer container-contacting panels and said inner product-supporting panels are made of a stiff paper-board material; and wherein said interconnected outer container-contacting said panels are arranged in or foldable into a mutually angled configuration so that said cushioning structure provides shock absorption support to said product during shock loading conditions in at least two mutually perpendicular directions.

2. The product cushioning structure as claimed in claim 1, wherein said stiff paper-board material is coated or blended with plastic, and said components are bonded together by heat sealing or welding the plastic.

3. The product cushioning structure as claimed in claim 2, wherein the plastic is polyethylene.

4. The product cushioning structure as claimed in claim 1, wherein box cell has the shape of a truncated pyramid .

5. The product cushioning structure as claimed in claim 1, wherein said open box cell is formed from a single sheet of said stiff paper-board material.

6. The product cushioning structure as claimed in claim 2, wherein said inner product-supporting panel and said inclined wall panels of each box cell are folded from said single sheet of stiff paper-board material along preformed fold lines.

7. The product cushioning structure as claimed in claim 6, wherein pleated folds are formed at the corners of the box cells, and the pleated folds are preserved to reinforce the integrity of the structure.

8. The product cushioning structure as claimed in claim 1, wherein lines of weakening are formed on said intermediate walls panels to control the direction of collapse of the box cells under shock loading conditions.

9. The product cushioning structure as claimed in claim 8, wherein said lines of weakening are crease lines.

10. The product cushioning structure as claimed in claim 1, wherein said outer container-contacting panels are hingedly interconnected so as to be foldable into said mutually angled configuration.

11. The product cushioning structure as claimed in claim 1, comprising said three container-contacting panels foldable into a corner configuration to fit snugly around the product and within the outer packaging container.

12. The product cushioning structure as claimed in claim 10, wherein said box cells have beveled mutually opposed edges so as to permit folding of the structure into said corner configuration.

13. The product cushioning structure as claimed in claim 1, comprising three aligned said container-contacting panels foldable into an end-cap configuration to fit snugly around the product and within the outer packaging container.

14. The product cushioning structure as claimed in claim 13, wherein said box cells have beveled mutually opposed edges so as to permit folding of the structure into said corner configuration.

15. The product cushioning structure as claimed in claim 1, wherein said box cells are constructed to trap gas inside to provide additional resistance to an external crushing action.

16. The product as claimed in claim 15, wherein said box cells are constructed to allow at least restricted gas outflow during the external crushing action to permit at least partial collapse of the box cells.

17. The product as claimed in claim 16, wherein said box cells are constructed to burst open when the external crushing action exceeds a threshold value.

18. The product cushioning structure for supporting a shock sensitive product in an outer packaging container having a plurality of container walls, said cushioning structure comprising:

at least two interconnected inner product-supporting panels for supporting the shock sensitive product within the cushioning structure;

an outwardly facing hollow crushable box cell provided on each of said inner-container contacting panels to provide shock absorption support to said product during shock loading conditions, each said crushable box cell comprising:

at least two outer container-contacting panels for supporting the shock sensitive product within the cushioning structure; and intermediate wall panels between said outer container-contacting panels and a unitary planar component formed by one said inner product-supporting panels forming an inner wall of said crushable box cell; and wherein at least one opposing pair of said intermediate wall panels are inclined such that that said crushable box cell has a trapezoidal shape in cross section, wherein said unitary planar component is bonded to said open crushable box cell at the periphery thereof to inhibit splaying of said inclined intermediate wall panels in the presence of a shock loading in a direction normal to said inner product-supporting panels;

wherein said outer container-contacting panels and said inner product-supporting panels are made of a stiff paper-board material; and wherein said interconnected outer container-contacting said panels are arranged in or foldable into a mutually angled configuration so that said cushioning structure provides shock absorption support to said product during shock loading conditions in at least two mutually perpendicular directions.

19. The product cushioning structure as claimed in claim 18, wherein said stiff paper-board material is coated or blended with plastic, and said components are bonded together by heat sealing or welding the plastic.

20. The product cushioning structure as claimed in claim 19, wherein the plastic is polyethylene.

21. The product cushioning structure as claimed in claim 18, wherein the percentage of polyethylene is 10 to 25% by weight.

22. The product cushioning structure as claimed in claim 18, wherein box cells generally have the shape of a truncated pyramid.

23. The product cushioning structure as claimed in claim 22, wherein said inner product-supporting panels and the intermediate wall panels are formed from a single sheet of said stiff paper-board material.

24. The product cushioning structure as claimed in claim 23, wherein said inner product-supporting panels and the intermediate wall panels are folded from said single sheet of stiff paper-board material along preformed fold lines.

25. The product cushioning structure as claimed in claim 24, wherein pleated folds are formed at the corners of the box-like cells, and the pleated folds are preserved to reinforce the integrity of the structure.

26. The product cushioning structure as claimed in claim 18, wherein lines of weakening are formed on said intermediate walls sections to control the direction of collapse of the box-like cells under shock loading conditions.

27. The product cushioning structure as claimed in claim 26, wherein said lines of weakening are crease lines.

28. The product cushioning structure as claimed in claim 18, wherein said panels are hingedly interconnected so as to be foldable into said mutually angled configuration.

29. The product cushioning structure as claimed in claim 18, comprising said three container-contacting panels foldable into a corner configuration to fit snugly around the product and within the outer packaging container.

30. The product cushioning structure as claimed in claim 28, wherein said box-shaped cells have beveled mutually opposed edges so as to permit folding of the structure into said corner configuration.

31. The product cushioning structure as claimed in claim 18, comprising three aligned said container-contacting panels foldable into an end-cap configuration to fit snugly around the product and within the outer packaging container.

32. The product cushioning structure as claimed in claim 28, wherein said box-shaped cells have beveled mutually opposed edges so as to permit folding of the structure into said corner configuration.

33. The product cushioning structure as claimed in claim 18, wherein said box cells are constructed to trap gas inside to provide additional resistance to an external crushing action.

34. The product as claimed in claim 33, wherein said box cells are constructed to allow at least restricted gas outflow during the external crushing action to permit at least partial collapse of the box-like cells.

35. The product cushioning structure for supporting a shock sensitive product in an outer packaging container:

at least one outer container contacting wall for providing contact with an outer packaging container in at least one of three mutually perpendicular directions;

a hollow box cell comprising an inner product supporting panel and inclined wall panels formed from a single sheet;

wherein said outer container contacting wall and said single sheet are bonded, glued, welded, or otherwise joined together forming a closed box cell structure;

wherein said closed cell structure is adapted to collapse to provide shock absorption support during shock loading conditions;

wherein outer container contacting wall is adapted to inhibit splaying apart of the wall panels and thus provide stabilizing support for the box cell during shock loading conditions;

wherein said product cushioning structure is adapted to provide shock absorption protection for a shock sensitive product during shock loading conditions in at least two of said three mutually perpendicular directions; and wherein said product cushioning structure is formed of a paper based sheet material.

* * * * *